United States Patent [19]

Sheckells

[11] Patent Number: 5,018,789

[45] Date of Patent: May 28, 1991

[54] MOUNTING ASSEMBLY FOR BACK OF TUBULAR FRAME SEATING

[75] Inventor: Amuel E. Sheckells, Senatobia, Miss.

[73] Assignee: Chromcraft Furniture Corporation, Senatobia, Miss.

[21] Appl. No.: 538,215

[22] Filed: Jun. 12, 1990

[51] Int. Cl.[5] ..... A47C 7/42

[52] U.S. Cl. ..... 297/444; 411/173; 411/183; 403/373

[58] Field of Search ..... 297/444, 443, 445, 446, 297/447; 411/183, 177, 173, 181, 180; 403/373, 377

[56] References Cited

U.S. PATENT DOCUMENTS

| | | | |
|---|---|---|---|
| 1,608,033 | 11/1926 | Nabors | 297/444 X |
| 2,457,294 | 12/1948 | Wood | 297/443 |
| 2,461,055 | 2/1949 | Greitzer | 297/444 |
| 2,703,604 | 3/1955 | Becker | 297/443 |
| 2,706,518 | 4/1955 | Fleischer | 297/444 |
| 2,961,037 | 11/1960 | Keefer | 297/443 |
| 3,556,592 | 1/1971 | Antoine | 297/444 |
| 4,275,925 | 6/1981 | Harder, Jr. | 297/444 |
| 4,828,438 | 5/1989 | Shackelford | 411/173 X |
| 4,875,815 | 10/1989 | Phillips, II | 411/183 X |
| 4,917,931 | 4/1990 | McDowell | 297/444 |

*Primary Examiner*—Peter A. Aschenbrenner
*Attorney, Agent, or Firm*—Wolf Greenfield & Sacks

[57] ABSTRACT

A chair with a tubular metal frame carrying a seat and backrest. The lower portion of the backrest is connected to the frame by at least one mounting assembly that includes metal straps that are mounted on the front and rear surfaces of the backrest core and connected together by the fasteners that pass through the straps and core. A bracket is secured to the strap on the rear surface of backrest and is welded to the portion of the metal frame which supports the backrest.

12 Claims, 5 Drawing Sheets

MOUNTING ASSEMBLY FOR BACK OF TUBULAR FRAME SEATING

INTRODUCTION

This invention relates to the construction of tubular furniture and more particularly to the mounting assembly for securing the back of seating to a tubular metal frame.

Business and Institutional Furniture Manufacturer's Association (BIFMA) and the International Standardization Organization (ISO) have established standards for the furniture industry with respect to stresses that furniture must withstand to gain approval of their organizations. For example, BIFMA requires that a tubular frame chair be capable of withstanding a load of 250 lbs. acting in a backward direction against the back. A somewhat lesser standard is imposed by ISO. The principle object of the present invention is to provide a convenient and relatively inexpensive mounting assembly for connecting the lower portion of a back to a tubular metal frame, which is capable of withstanding loads in excess of the minimums required for BIFMA and ISO approval.

Heretofore, no one to Applicant's knowledge has provided a tubular frame chair with a back having a non-metallic core supported near its bottom and capable of passing ISO and BIFMA testing with an economically acceptable mounting assembly and a frame of relatively small tube diameter of approximately 1¼ inch and either round, oval or square in cross-section.

In accordance with the present invention the backrest of the tubular frame chair having a non metallic core is provided with a pair of metal straps aligned with one another on the front and rear surfaces of the core and attached together by rivet nuts which extend through the straps and the core material. In one embodiment of the present invention a pair of relatively wide straps are secured vertically along the center line of the backrest and extend over a substantial portion of its height. A back bracket is attached to the lower end of the strap on the back surface of the core which in turn is welded or otherwise directly attached to the tubular frame. In this embodiment the bracket is designed to engage and be welded to a horizontal portion of the frame which extends across the back.

In accordance with a second embodiment of the present invention, two pairs of metal straps are mounted on the core, each sandwiching the core material along a side edge thereof. Separate brackets are secured to the rear strap of each pair, and the brackets are designed to be welded to vertically extending portions of the chair frame.

These and other objects and features of the present invention will be better understood and appreciated from the following detailed description of two embodiments thereof, selected for purposes of illustration and shown in the accompanying drawings:

BRIEF FIGURE DESCRIPTION

DETAILED DESCRIPTION

Figure 1:
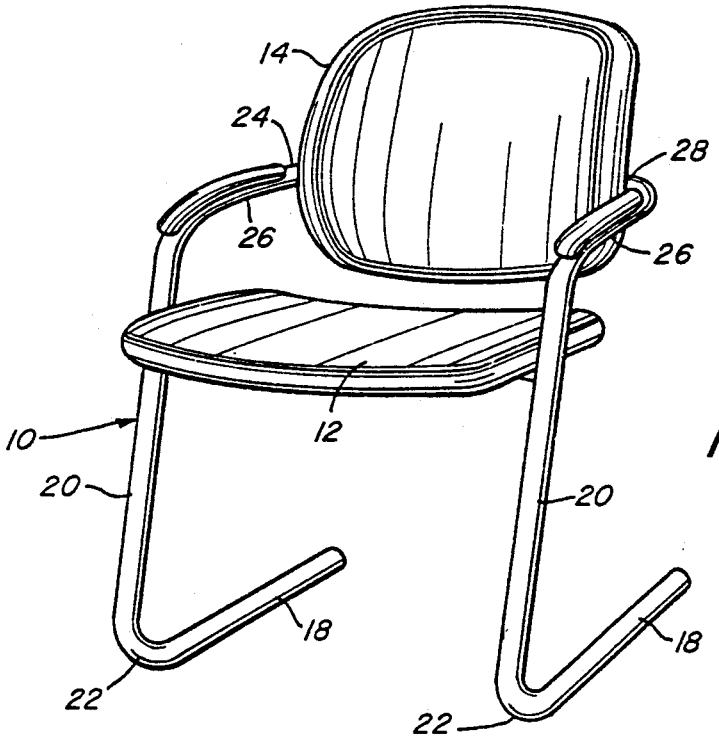
FIG. 1 is a perspective view of one embodiment of a cantilever sled chair constructed in accordance with the present invention.

The chair shown in FIGS. 1–7 includes a sled type metal tubular frame 10, a seat 12 and backrest 14. This invention particularly relates to the mounting assembly 16 shown in FIGS. 2–7 for securing the back 14 to the frame 10.

The frame 10 includes two base sections 18 that rest on the floor. Upwardly extending sections 20 join the base sections 18 at the radii 22, and the sections 20 in turn merge smoothly into the upper section 24 of the frame 10, which includes the arm sections 26 and back section 28.

The backrest 14 is composed of a non metallic core 30 which is normally covered on both the front and rear surfaces 32 and 34 by a foam pad which in turn is covered by a suitable upholstery fabric. For clarity, both the foam and fabric ar omitted from the drawings. The core is approximately ¼ inch thick and may be made of wood, plastic, pressed paper or some similar material. The back is appropriately contoured to satisfy both the design and comfort requirements and preferably is somewhat flexible so that it can bend to accommodate the different body shapes of those who use the chair.

Figure 2:
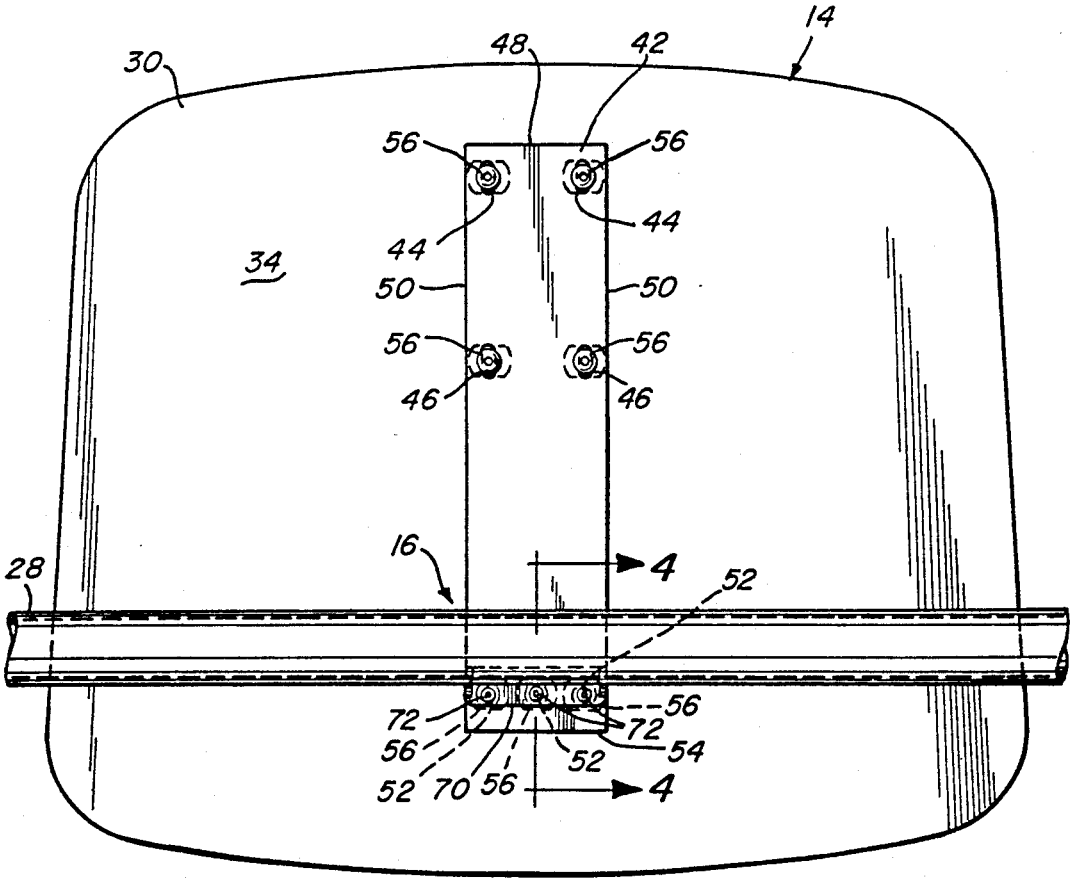
FIG. 2 is a rear elevation view of the back of the chair shown in FIG. 1.
Figure 3:
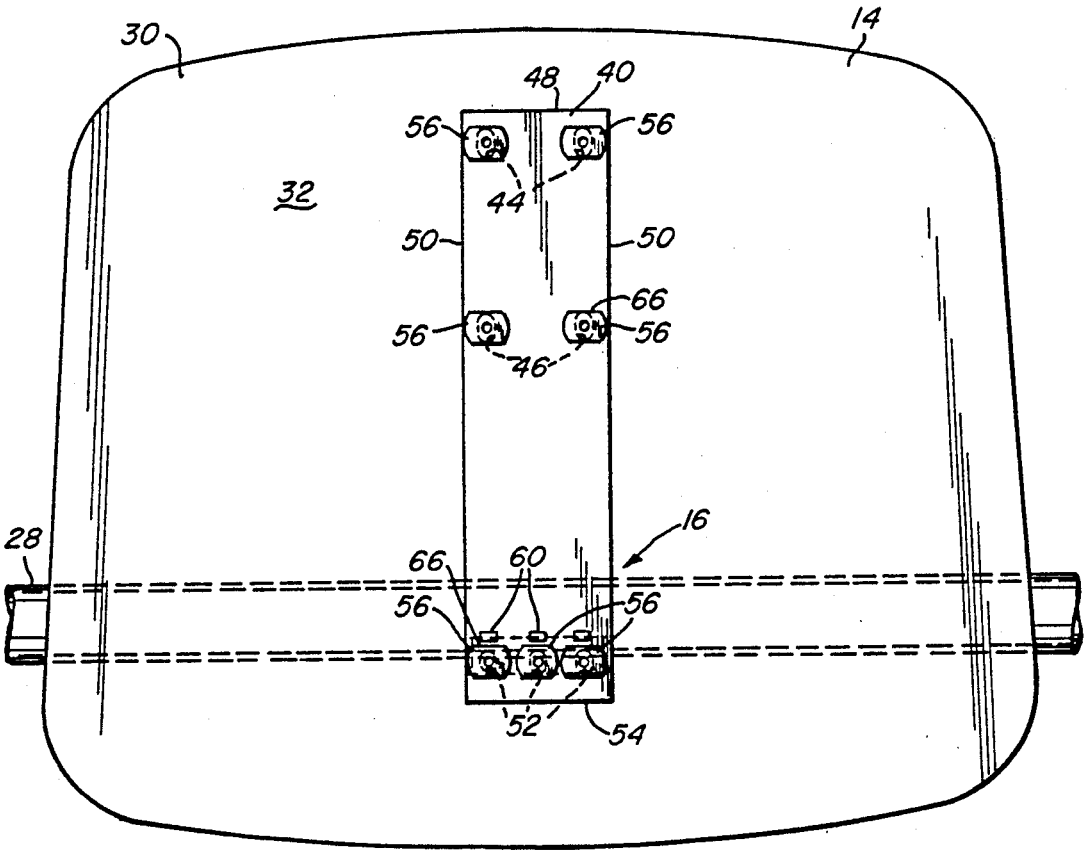
FIG. 3 is a front elevation view of the front of the back of the chair shown in FIG. 1.
Figure 4:
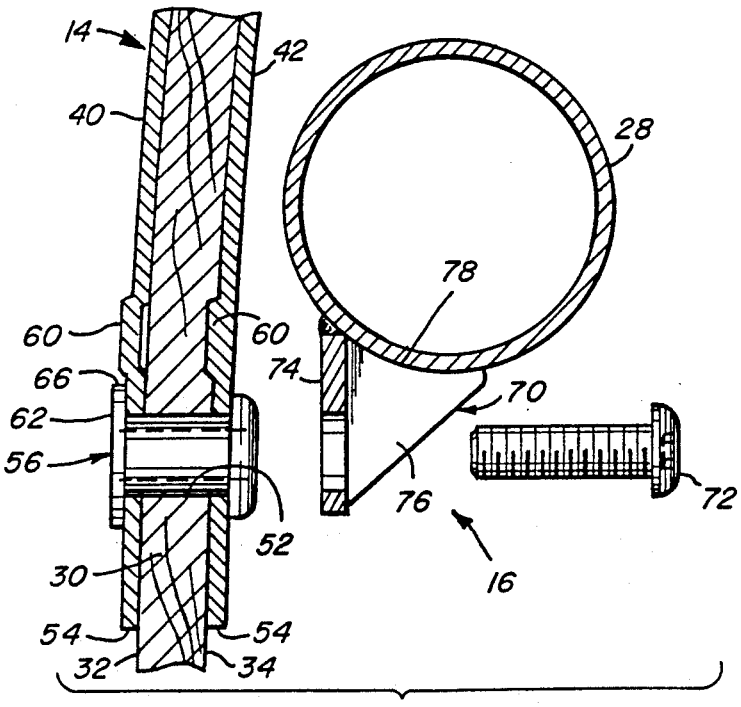
FIG. 4 is a cross sectional view of the chair taken along section line 4—4 in FIG. 2.

As shown in FIGS. 2–4 a pair of essentially identical straps 40 and 42 are secured to the front and rear surfaces 32 and 34 of the core and extend vertically in alignment with the vertical center line of the back. The straps typically may be made of 16 gauge steel and be approximately 2.3 inches wide and 10 inches long. In the embodiment shown, each strap is provided with two pairs of oval holes 4 and 46 located respectively adjacent the top edge 48 and approximately one third down from that edge and adjacent the side edges 50. Three holes 52 are provided in each strap adjacent the lower edge 54. The two straps 40 and 42 are secured together by rivet nuts 56 that join the two straps through the holes 44, 46 and 52 on the strap and aligned holes provided in the core 30.

It should be noted in FIG. 4 that spaced upwardly a short distance from the holes 52 are punched protrusions 60 in each of the straps The protrusions on the strap 32 cooperate with the heads 62 of the rivet nuts 56 to prevent the rivet nuts from rotating once they are installed. As shown in FIG. 3, the heads 62 of the rivet nuts include a flat edge 66 that will engage the adjacent protrusion 60 if the rivet nut turns in the holes.

Figure 5:
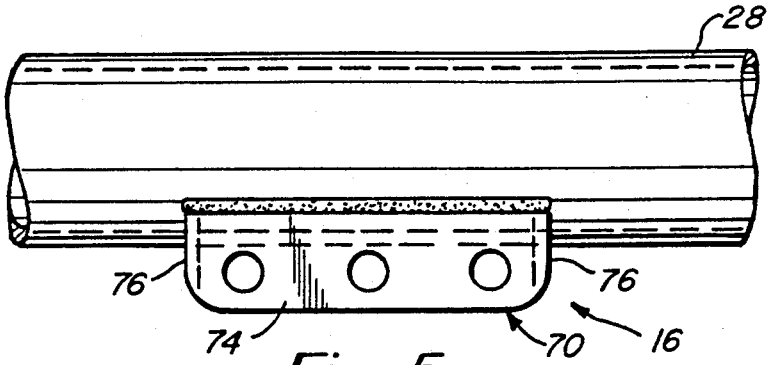
FIG. 5 is a fragmentary view of the rear section of the chair frame and the bracket which connects the frame to the backrest.
Figure 6:
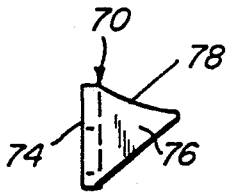
FIGS. 6 and 7 are side and bottom views of the bracket shown in FIG. 5.
Figure 7:
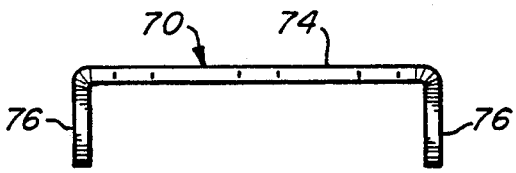

The back tubular section 28 of frame 10 is connected to the mounting assembly 16 by a bracket 70 welded to the middle of back section 28 of the frame and fastened to the mounting assembly by screws 72. The details of the bracket are shown in FIGS. 5–7. The screws 72 mate with the rivet nuts passing through holes 52 in the straps. Bracket 70 is composed of a substantially flat plate 74 and a pair of side flanges 76, one at each end of the plate 74. The upper edges 78 of the flanges are curved to conform to the curvature of the tubular back section 28. The flanges 76 may be spot welded to the tubular back section 28 so as to permanently join the two together. Therefore, when the bracket 70 is secured to the mounting assembly by means of the screws 72 and rivet nuts 56, the back is firmly secured to the frame.

In the embodiment shown in FIGS. 1–7, the tubular frame 10 may be made of 1¼ inch round stock and have a wall thickness of 0.060 inches. While the frame is shown to be round in cross section at the back section 28, it is to be understood that other cross-sectional shapes may be used such as oval, square etc.

Figure 8:
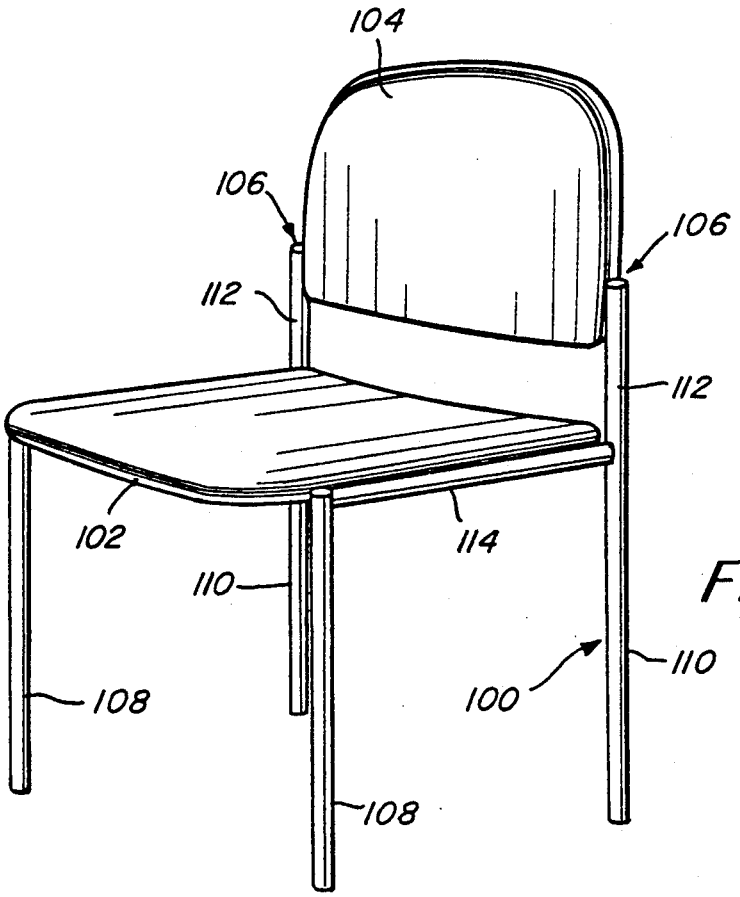
FIG. 8 is perspective view of a second embodiment of this invention in the form of an armless tubular frame chair.
Figure 9:
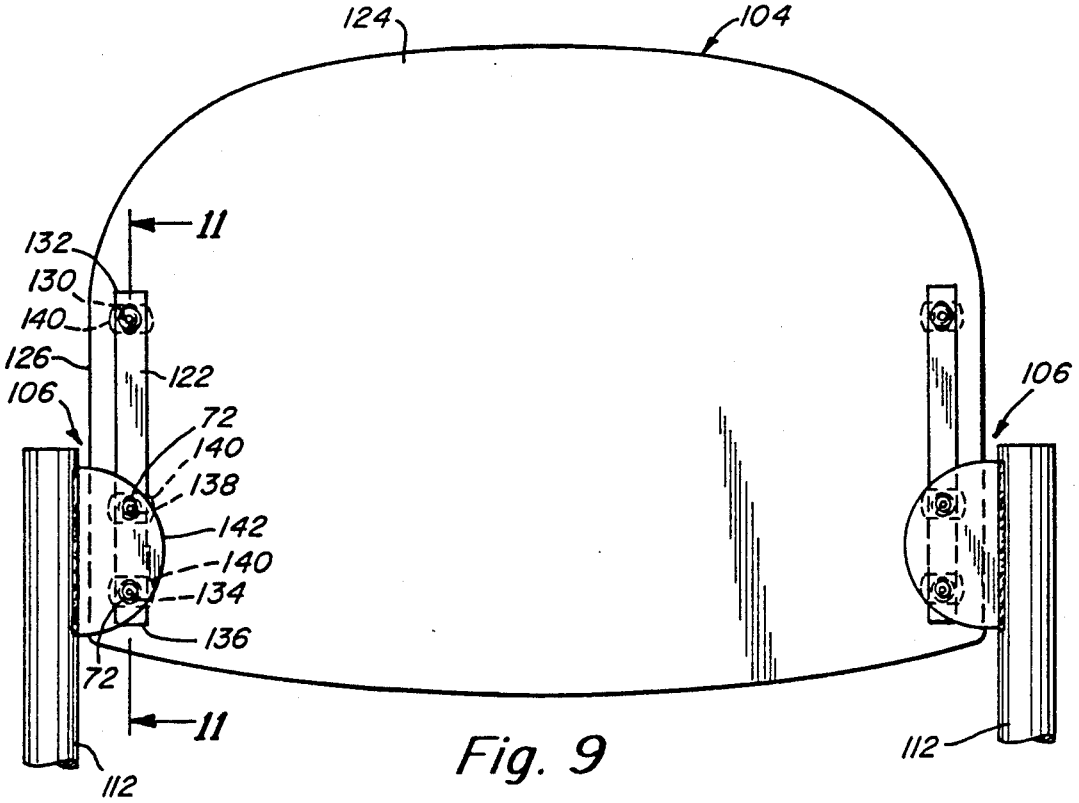
FIG. 9 is rear elevation view of the chair shown in FIG. 8.
Figure 10:
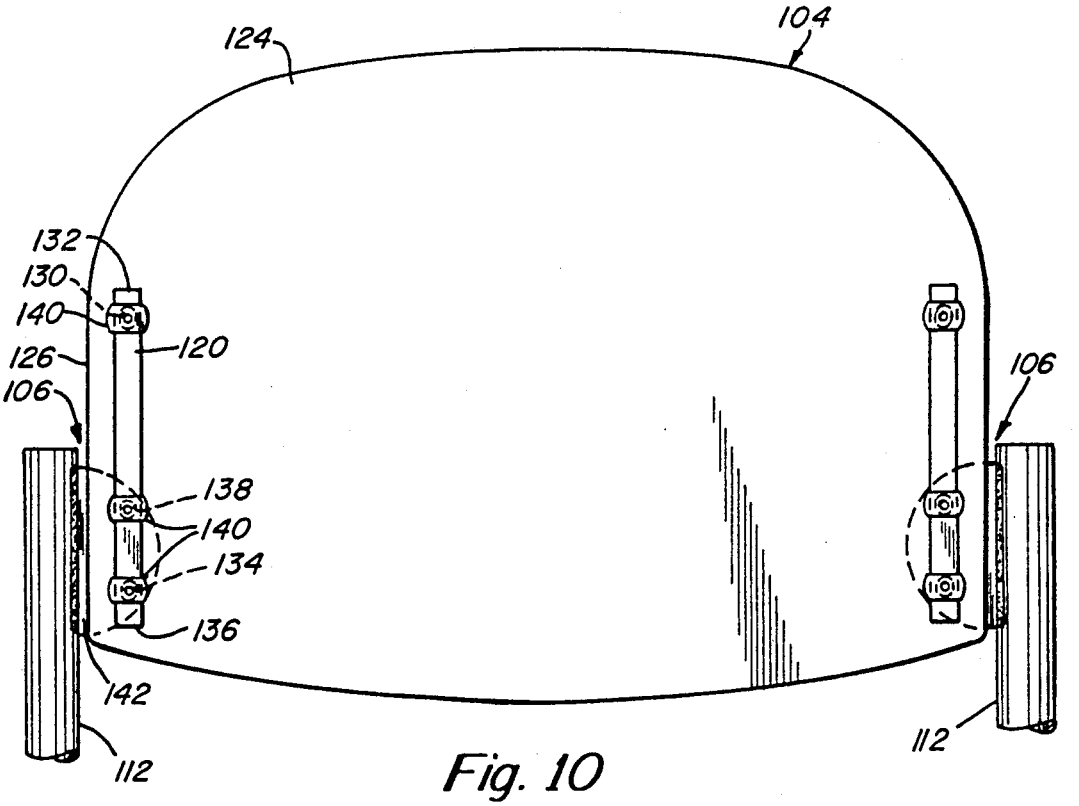
FIG. 10 is a front elevation view of the back of the chair shown in FIG. 8.
Figure 11:
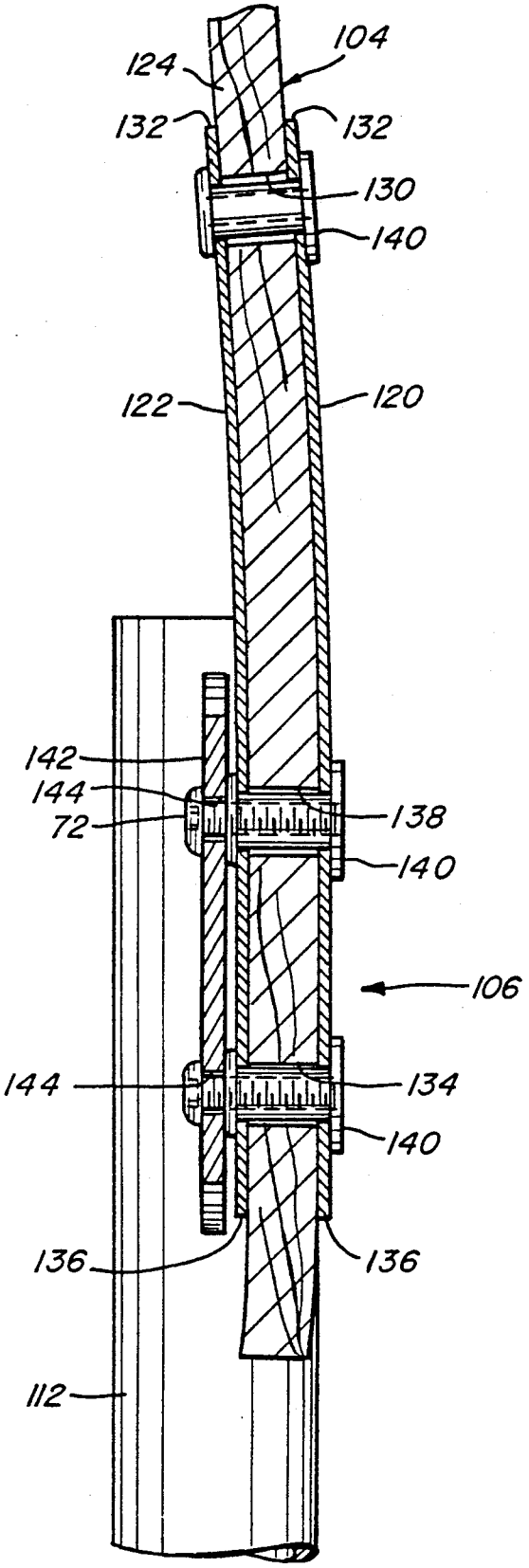
FIG. 11 is a cross sectional view of the second embodiment taken along the section line 11—11 in FIG. 9.
Figure 12:
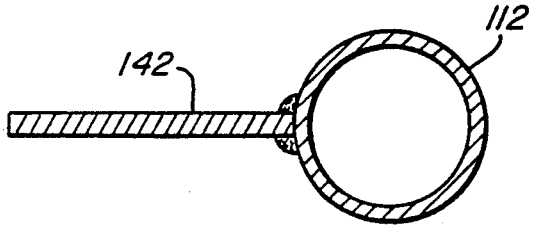
FIG. 12 is a cross sectional view of the vertical section of the chair frame and bracket to connect the backrest to the frame in the second embodiment.

In the embodiment shown in FIGS. 8–12 the backrest is attached to the frame by a pair of mounting assemblies, one on each side of the backrest. Referring to FIG. 8, the tubular frame chair shown includes a frame 100, a seat 102 and back 104 The back 104 is attached to the frame 100 by a pair of mounting assemblies 106 shown in detail in FIGS. 9–12. The frame 100 has a pair of front legs 108 and a pair of back legs 110. The back legs have upper vertical sections 112 that extend above the seat and to which the back 104 is connected by the mounting assemblies 106. The seat may be supported in any desired fashion by the frame, and in the embodiment shown, the side edges of the seat are secured to the horizontal tubular sections 114 of the frame which join the front and back legs.

In FIGS. 9–12, details of the mounting assemblies 106 are shown. One assembly is used adjacent each side edge of the back. Because they are mirror images of one another, only one need be described. In accordance with this embodiment, a pair of narrow straps 120 and 122 are secured to the front and back of the core 124 of the backrest 104 adjacent one side edge 126 thereof. The straps 120 and 122 in this embodiment are narrower and shorter than the straps of the first embodiment. The straps 120 and 122 are made of 0.060 inch thickness gauge steel approximately 0.5 inches wide and 6 inches long. The straps each have a hole 130 formed adjacent the top edge 132, a second hole 134 adjacent the bottom edge 136, and a third hole 138 approximately one third up from the bottom edge 136. The holes 134 and 138 are approximately 1.5 inches apart. As in the first embodiment the pair of straps sandwich the core 124 and are secured to it by rivet nuts 140.

The upper vertical sections 112 of the rear legs 110 of the frame each carry a semi circular plate 142 which is welded to it, and the plates are substantially co-planar. Their precise orientation is, of course, a function of the contours of the back 104. If the curvature of the back in a horizontal plane is pronounced, the plates 142 will extend not only inwardly of the chair but somewhat backwardly as well. The plates in turn are provided with a pair of holes 144 which align with the holes 134 and 138 and through which screws extend and engage the rivet nuts mounted in the holes 134 and 138. In this simple fashion the back is mounted on the frame.

The core 124 of the backrest 104 like the core in the first embodiment may be made of wood, plastic, pressed paper, etc. The tubular steel frame may typically be one inch in diameter and have a wall thickness of 0.60 inches. It is also to be understood that protrusions may be provided in the straps 120 and 122, comparable to the protrusions in the first embodiment, so as to prevent the rivet nuts from rotating once assembled in the chair. While in the first embodiment the protrusions are shown only adjacent the bottom row of rivet nuts, they may in fact be employed adjacent all of the rivet nuts in either of the two embodiments if desired.

Each of the embodiments of the present invention allows the back to be attached, adjacent its bottom, to the frame and yet provide sufficient strength so that the chair surpasses the BIFMA and ISO requirements. In the first embodiment of FIGS. 1–7, tests indicate that a load of 348 lbs. may be applied to this particular design. In the absence of the straps, a load of even 150 lbs. could not be sustained. The use of the sandwich-like construction composed of the metal straps connected by the rivet nuts greatly increases the strength of the connection between the back and the frame. The assembly composed of the straps and core act as an I-beam under stress with the core forming the I beam web. Increased strength derived from this construction, which is relatively inexpensive and convenient to assemble, enables the chairs to meet the standards established by the leading testing labs in the industry without significantly increasing manufacturing costs.

Having described this invention in detail those skilled in the art will appreciate that numerous modifications made on the invention without departing from its spirit. Therefore, it is not intended that the scope of the invention be limited to the specific embodiments illustrated and described. Rather, its scope is to be determined by the appended claims and their equivalents.

What is claimed is:

1. In seating having a tubular frame and a back secured to the frame, an improved mounting assembly for securing the back to the frame comprising a back having a non metallic core made of wood, plastic, pressed paper or the like, said back having front and rear surfaces, a pair of similarly shaped metal straps in substantial alignment with one another and attached to opposite surfaces of the core to form a sandwich of the core, a plurality of fasteners each extending through both the metal straps and the core to bind the straps in place on the core, a metal back bracket secured to the strap on the rear surface of the back, and means permanently securing the back bracket to the tubular frame of the chair to hold the back in place on the frame.

2. In seating as defined in claim 1, said straps extending vertically on the core, and said tubular frame being horizontally oriented at the location where the bracket is attached to it.

3. In seating as defined in claim 2, said straps extending over a major portion of the vertical extent of the core of the back.

4. In seating as defined in claim 3, said straps being disposed along the vertical center line of the core.

5. In seating as defined in claim 1, said straps extending vertically on the core, and said tubular frame being vertically oriented at the location where the bracket is attached to it.

6. In seating as defined in claim 1, a second pair of similarly shaped metal straps in substantial alignment with one another and attached to opposite surfaces of the core and fasteners extending through the core and straps to secure the straps on the core, a second metal bracket secured to the second pair of straps on the rear surface of the core, and a second vertically oriented frame section permanently secured to the second bracket, said pairs of straps being disposed vertically and lying adjacent opposite side edges of the core.

7. In seating as defined in claim 1, said fastener being rivet nuts.

8. In seating as defined in claim 7, said bracket being secured to the strap by screws which engage the rivet nuts.

9. In seating as defined in claim 3, said fastener being rivet nuts.

10. In seating as defined in claim 9, said bracket being secured to the strap by screws which engage the rivet nuts.

11. In seating as defined in claim 6, said fastener being rivet nuts.

12. In seating as defined in claim 11, said bracket being secured to the strap by screws which engage the rivet nuts.

* * * * *